United States Patent [19]

Persson

[11] 4,448,271

[45] May 15, 1984

[54] EARTH BORING DEVICE

[75] Inventor: Erik A. Persson, Sandviken, Sweden

[73] Assignee: Santrade Ltd., Lucerne, Switzerland

[21] Appl. No.: 321,260

[22] Filed: Nov. 13, 1981

[30] Foreign Application Priority Data

Mar. 31, 1981 [SE] Sweden ..... 8102049

[51] Int. Cl.[3] ..... E21B 10/10

[52] U.S. Cl. ..... 175/364; 384/428

[58] Field of Search ..... 175/364, 363, 367, 368–372; 384/96, 428

[56] References Cited

U.S. PATENT DOCUMENTS 3,835,944 9/1974 Bingham ..... 175/364
3,851,718 12/1974 Fink ..... 175/364
3,863,994 2/1975 Fink ..... 175/364
4,004,644 1/1977 Liljekvist et al. ..... 175/364

*Primary Examiner*—William F. Pate, III
*Assistant Examiner*—Hoang C. Dang
*Attorney, Agent, or Firm*—Burns, Doane, Swecker & Mathis

[57] ABSTRACT

A roller cutter assembly for rotary boring of the face of earth formations comprising a boring head (16) and a plurality of roller cutters (14) mounted in mounting members (15). The bearing shafts (25) of the roller cutters (14) are secured to the mounting members (15) by members of clamping bolts (30). For purposes of eliminating the risk for failure of the clamping bolts (30) to occur the mounting members (15) are provided with a cap portion (31).

1 Claim, 2 Drawing Figures

EARTH BORING DEVICE

The present invention relates generally to an earth boring device and more precisely to a roller cutter assembly for rotary boring of the face of earth formations comprising a boring head and at least one mounting means for a roller cutter, said boring head having a mounting face and said mounting means being carried on said mounting face, wherein the roller cutter is provided with a bearing shaft having first and second supporting faces which are non-parallel with respect to each other, the mounting means is provided with a first and a second arm portion which project from the mounting face and which are provided with a third and forth, respectively, supporting face, said third and fourth supporting faces being adapted to cooperate with the first and second supporting faces so as to prevent rotation of the bearing shaft relative to the mounting means, said first, second, third and forth supporting faces being non-parallel with respect to the mounting face, and comprising a clamping means which is adapted to secure the bearing shaft to the arm portions in such a way that the supporting faces of the bearing shaft are clamped against the supporting faces of the arm portions. The invention relates further to a roller cutter and a mounting means intended to be used in the roller cutter assembly.

The invention relates generally to earth boring, but is particularly intended for raise boring. In raise boring a pilot hole is drilled between a lower level and an upper level in a mine, whereupon the pilot hole is enlarged by means of a reaming head having a large diameter.

If the roller cutter assembly has to be withdrawn out of the hole before the hole is completed, for instance for purposes of repairing the assembly, there is a risk that the outermost roller cutters will get caught by the wall of the bore hole. The clamping means which secure the bearing shafts to the mounting means are then subjected to extremely high stresses and can get broken during unfavourable circumstances. The object of the present invention is to unload the clamping means during the withdrawal of the roller cutter assembly. Another object of the invention is to positively prevent rotation of the bearing shafts relative to the mounting means during drilling without exposing the clamping means to unacceptable high stresses.

The above and other objects of the invention are attained by giving the invention the characterizing features stated in the appending claims.

The invention is described in detail below with reference to the accompanying drawings in which one embodiment is shown by way of example. It is to be understood that this embodiment is only illustrative of the invention and that various modifications thereof may be made within the scope of the claims.

Figure 1:
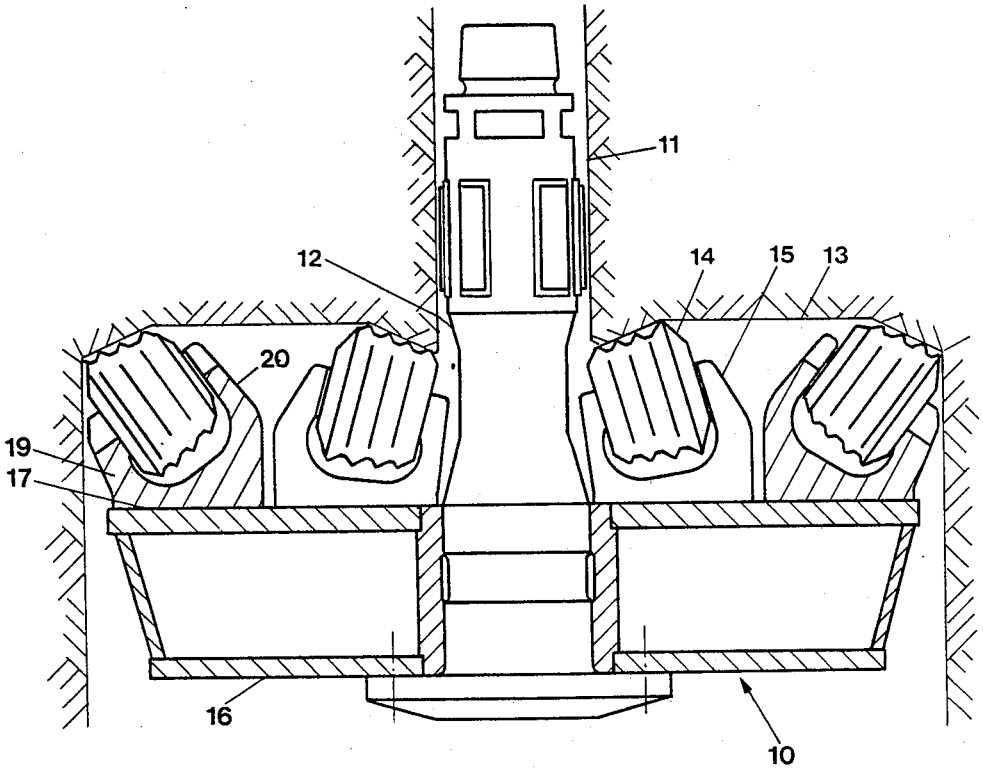

In the drawings, FIG. 1 shows in section a roller cutter assembly according to the invention.

Figure 2:
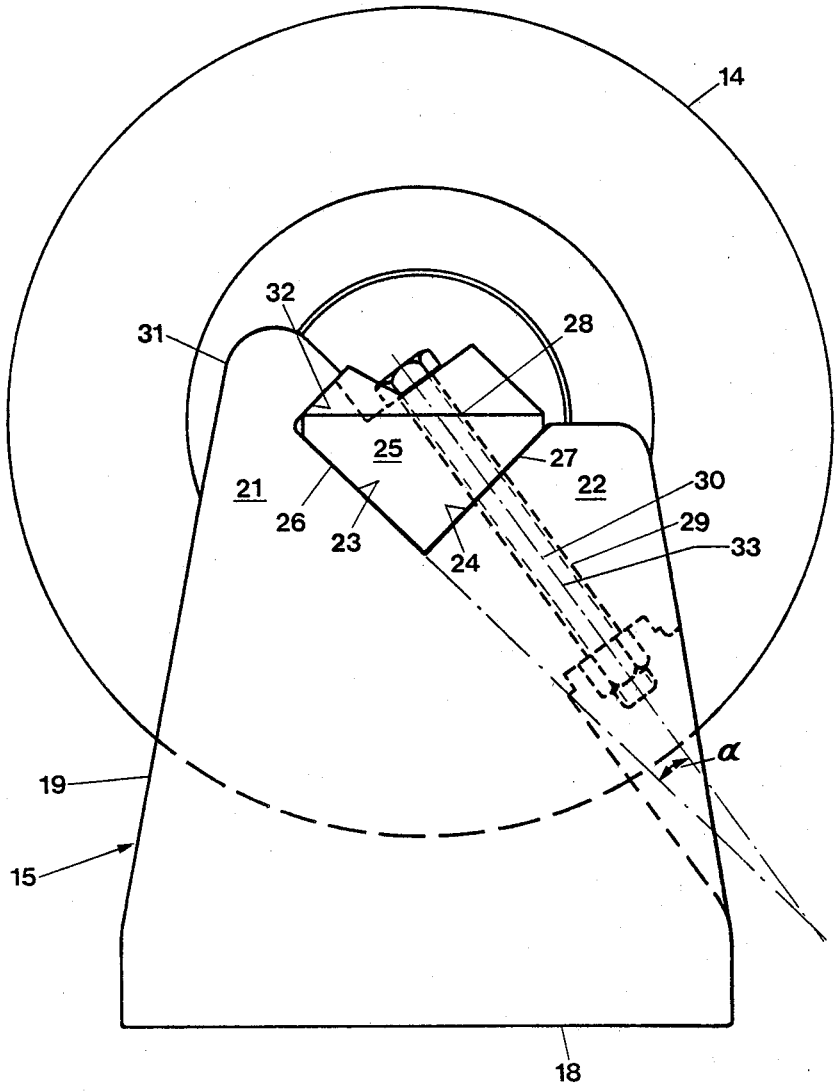

FIG. 2 shows a side view of a roller cutter and a mounting means according to the invention and being incorporated in the assembly in FIG. 1.

In the drawings a pilot hole 11 pre-drilled in conventional manner between an upper level and a lower level, not shown, in a mine is reamed by means of a roller cutter assembly generally depicted by the reference numeral 10. The roller cutter assembly 10 is attached to a drive stem 12 by means of which the assembly is rotated and forced against an annular surface 13 which surrounds the pilot hole 11. The surface 13, thus, defines the face of the earth formation. A plurality of roller cutters 14 are rotatably journalled in mounting means or saddles 15 on a boring head 16. The saddles 15 are mounted on the boring means 16 as shown in Swedish patent specification No. 79 00922-1. The drive stem 12 is connected to the boring head 16 as shown in Swedish patent specification No. 77 10129-3.

The boring head 16 is provided with a mounting face 17 on which the saddles 15 are carried. The saddle 15 comprises a bottom surface 18 which is adapted to be connected to the mounting face 17, for instance by welding. The saddle 15 comprises further two legs 19, 20 between which the roller cutter 14 is mounted. The legs 19, 20 are provided with arm portions 21, 22 at the end thereof opposite to the bottom surface 18. The arm portions 21, 22 are provided with mutually opposed supporting faces 23, 24 which are non-parallel with respect to each other and with respect to the bottom surface 18.

The roller cutter 14 comprises a bearing shaft 25 which is provided with supporting faces 26, 27. The supporting faces 26, 27 are adapted to rest against the supporting faces 23, 24. The bearing shaft 25 is provided with a traversing bore 28 which intersects the supporting face 27. The bore 28 is in alignment with a bore 29 in the arm portion 22. A clamping means in form of a bolt 30 extends through the bores 28, 29 and forces the supporting faces 26, 27 of the bearing shaft against the supporting faces 23, 24.

According to the invention the arm portion 21 is provided with a cap portion 31 having a supporting face 32 which is directed toward the mounting face 17. The supporting face 32 cooperates with the bearing shaft 25 in such a way that movement thereof is prevented in a direction perpendicular to the mounting face 17, i.e., in the longitudinal direction of the drive stem 12. The supporting face 24 is opposed to the supporting face 32 and parallel thereto. In the illustrated embodiment the supporting faces 23, 24 form a ninety degree angle between themselves and a forty-five degree angle with the bottom surface 18.

The bore 28 through the bearing shaft 25, and thus also the bore 29 through the arm portion 22, forms an angle $\alpha$ with the supporting face 26. According to the invention the angle $\alpha$ is 10°. Further, the distance between the centre line 33 of the bores 28, 29, when measured along the supporting face 27, from the intersection between the centre line 33 and the supporting face 27 to the transition between the supporting faces 26, 27 is half the length of the supporting face 26.

According to the invention, thus, it is ensured, due to the cooperation between the cap portion 31 and the bearing shaft 25, that no unacceptable high stresses arise in the bolt 30; neither during withdrawal of the assembly out of a not yet finished hole since the cap portion locks the roller cutter 14 against movement in the longitudinal direction of the drive stem 12, nor during drilling since the cap portion locks the bearing shaft 25 against rotation relative to the saddle 15.

I claim:

1. A roller cutter assembly for rotary boring the face of an earth formation, comprising:

a boring head having a mounting face, a roller cutter including a bearing shaft having first and second supporting faces which are mutually non-parallel, mounting means carried on said mounting face and supporting ends of said shaft, said mounting means including first and second arm portions extending away from said mounting face, said first and second arm portions respectively including third and fourth supporting faces which engage said first and second supporting faces, respectively, to prevent rotation of the bearing shaft relative to said mounting means, said first, second, third, and fourth supporting faces being non-parallel relative to said mounting face, and a bolt extending through a hole in said bearing shaft for clamping said first and second supporting faces against said third and fourth supporting faces, respectively, said bolt being arranged such that its longitudinal axis intersects said second and fourth supporting faces, said first arm portion including a cap portion having a fifth supporting face which faces generally in the direction of both said fourth supporting face and said mounting face and is engageable with said bearing shaft to prevent independently of said bolt, movement of said bearing shaft in a direction perpendicularly away from said mounting face and prevent, independently of said bolt, rotation of said bearing shaft relative to said mounting means.

* * * * *